US012409370B2

(12) United States Patent
Friedman

(10) Patent No.: US 12,409,370 B2
(45) Date of Patent: Sep. 9, 2025

(54) ADJUSTABLE MEDICINE BALL

(71) Applicant: Ian Michael Friedman, Egg Harbor Township, NJ (US)

(72) Inventor: Ian Michael Friedman, Egg Harbor Township, NJ (US)

( * ) Notice: Subject to any disclaimer, the term of this patent is extended or adjusted under 35 U.S.C. 154(b) by 221 days.

(21) Appl. No.: 18/199,955

(22) Filed: May 21, 2023

(65) Prior Publication Data

US 2024/0382814 A1 Nov. 21, 2024

(51) Int. Cl.
*A63B 65/06* (2006.01)
*A63B 21/075* (2006.01)

(52) U.S. Cl.
CPC ..... *A63B 65/06* (2013.01); *A63B 21/075* (2013.01)

(58) Field of Classification Search
CPC ..... A63B 21/072; A63B 21/075; A63B 23/02; A63B 23/0205; A63B 65/06
See application file for complete search history.

(56) References Cited

U.S. PATENT DOCUMENTS 6,387,022 B1 * 5/2002 Smith ..... A63B 65/06 482/106
8,454,483 B1 * 6/2013 Bradley ..... A63B 21/072 482/44
8,568,280 B2 * 10/2013 Mendoza ..... A63B 21/0722 482/93
8,636,625 B2 * 1/2014 Johnson ..... A63B 21/072 482/44
8,882,642 B2 * 11/2014 Chavez ..... A63B 23/03575 482/121
9,242,149 B2 * 1/2016 Carter ..... A63B 37/12
9,352,180 B2 * 5/2016 Pawlas ..... A63B 69/305
9,545,534 B2 * 1/2017 Crandall ..... A63B 21/0601
9,616,272 B1 * 4/2017 Bennett ..... A63B 21/00065
9,694,230 B2 * 7/2017 Cooper ..... A63B 21/072
9,770,619 B1 * 9/2017 Bullock ..... A63B 65/06
11,331,532 B2 * 5/2022 Hunt ..... A63B 21/072
11,878,200 B2 * 1/2024 Duplain ..... A63B 21/075
11,931,619 B2 * 3/2024 Jackson ..... A63B 21/0726
2003/0100408 A1 * 5/2003 Chuang ..... A63B 21/222 482/44
2012/0053024 A1 * 3/2012 Mendoza ..... A63B 21/0722 482/106
2012/0149536 A1 * 6/2012 Trimble ..... A63B 21/00065 53/469

(Continued)

*Primary Examiner* — Joshua Lee

(57) ABSTRACT

The present invention relates to a SmartSphere Adjustable Medicine Ball with or without handles, which provides a versatile and customizable fitness solution for users of various fitness levels and goals. It incorporates adjustable weighted bands that allow users to modify the weight of the ball by increasing or decreasing the band weight. The SmartSphere features a spherical body with or without textured handles for improved grip and control during exercise. A secure locking mechanism ensures the desired weight is held in place. With its ergonomic design, durable construction, and seamless exterior surface, the SmartSphere offers a comfortable and reliable exercise experience. The SmartSphere Adjustable Medicine Ball is designed to improve muscle strength, coordination, and overall fitness, while addressing the limitations of traditional medicine balls by providing adjustable weight options in a compact and convenient form.

13 Claims, 6 Drawing Sheets

(56) References Cited

U.S. PATENT DOCUMENTS

| | | | | |
|---|---|---|---|---|
| 2012/0157270 | A1* | 6/2012 | Johnson | A63B 21/072 482/93 |
| 2013/0085045 | A1* | 4/2013 | Chavez | A63B 23/03575 482/93 |
| 2015/0045191 | A1* | 2/2015 | Carter | A63B 41/125 482/93 |
| 2015/0065313 | A1* | 3/2015 | Cooper | A63B 21/0603 482/93 |
| 2015/0190672 | A1* | 7/2015 | Rost | A63B 21/00065 482/141 |
| 2015/0343257 | A1* | 12/2015 | Cooper | A63B 21/0609 482/93 |
| 2016/0107017 | A1* | 4/2016 | Pawlas | A63B 69/305 482/93 |
| 2020/0206594 | A1* | 7/2020 | Keller | A63B 45/00 |
| 2021/0016131 | A1* | 1/2021 | Hunt | A63B 21/0604 |
| 2023/0131423 | A1* | 4/2023 | Kordecki | A63B 21/151 482/139 |

* cited by examiner

ADJUSTABLE MEDICINE BALL

COPYRIGHT NOTICE

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND

Field of the Invention

The present invention relates to the field of fitness equipment and, more specifically, to an adjustable medicine ball with or without handles. The invention encompasses a SmartSphere Adjustable Medicine Ball that provides users with a versatile and customizable exercise tool for strength training, coordination, and overall fitness improvement. The SmartSphere offers an innovative design that allows users to adjust the weight of the ball using the weighted bands system to meet desired fitness levels while maintaining comfort, stability, and effectiveness.

Description of the Related Art

The SmartSphere Adjustable Medicine Ball represents a significant advancement in the field of medicine balls with or without handles. While medicine balls with handles have been used for centuries to improve musculature, strength, and coordination, the SmartSphere offers unique benefits and addresses limitations found in traditional medicine balls available today. Unlike the sand-filled or filler-filled balls of the past, the SmartSphere features an innovative design that allows for easy weight adjustment, providing users with enhanced versatility and convenience in their workouts.

Traditional medicine balls have been utilized in strength, aerobics, and resistance training, but they often come in specific weight options, requiring users to own multiple balls of different weights for various exercises. This inconvenience and space requirement can impact the efficiency of workouts. However, the SmartSphere's adjustable weight capacity solves this problem by allowing users to modify the weight of the ball according to their specific needs, eliminating the need for multiple medicine balls and streamlining workout routines.

While adjustable weight capacities are available for kettlebells and dumbbells, no known adjustable medicine balls exist in the market. The SmartSphere fills this gap by offering a unique solution that maintains the shape and size of the medicine ball while allowing for weight adjustments. This ensures optimal usability and comfort during exercises.

Other devices on the market may have limitations in terms of comfort, weight adjustment, and exercise versatility. The SmartSphere aims to overcome these difficulties and problems by providing users with a comfortable and safe fitness tool that can be easily adjusted in weight without altering its shape. By reducing workout time, optimizing space availability, and offering enhanced exercise possibilities, the SmartSphere stands apart from previous inventions and patents.

In summary, the SmartSphere Adjustable Medicine Ball addresses the shortcomings of existing medicine balls with or without handles by offering an adjustable weight capacity, versatile exercise options, and improved user comfort. It represents a significant advancement in the field, allowing users to optimize their workouts, save space, and achieve their fitness goals efficiently and effectively.

SUMMARY

The present invention addresses the drawbacks of prior fitness exercise devices, particularly focusing on the innovation of the SmartSphere Adjustable Medicine Ball. This novel fitness tool combines the benefits of a traditional medicine ball with the convenience and customization of adjustable weight bands, offering a unique and improved exercise experience.

The primary objective of the invention is to overcome the limitations of existing exercise devices by providing a SmartSphere Adjustable Medicine Ball with or without handles that allows users to adjust the weight to their desired level. Unlike traditional medicine balls with fixed weights, this adjustable feature caters to different fitness levels and preferences.

Another objective of the invention is to design an exercise device that considers various body parts, ensuring that weight adjustment does not affect the overall center of gravity. The SmartSphere Adjustable Medicine Ball with or without handles maintains balance and stability, providing a seamless workout experience.

Furthermore, the invention aims to provide versatility by allowing the SmartSphere Adjustable Medicine Ball with or without handles to be used as a standalone medicine ball or enhanced with add-on for advanced workout routines. Users are encouraged to explore their creativity and imagination in utilizing the device.

The SmartSphere Adjustable Medicine Ball is a comprehensive fitness tool suitable for a wide range of exercises, including strength training, balance exercises, and cardio workouts. It offers users the ability to customize their fitness routines and adapt to their evolving fitness goals.

Additionally, the invention emphasizes ease of use, convenience, and portability. The smart assembly of the SmartSphere Adjustable Medicine Ball ensures user-friendly operation and enables users to carry the device effortlessly, allowing for workouts anytime and anywhere.

In conclusion, the SmartSphere Adjustable Medicine Ball with or without handles represents a significant advancement in the field of medicine balls. The invention addresses existing limitations and offers various advantages in the adjustable weight system.

DESCRIPTION OF THE DRAWINGS

The accompanying figures, with consistent reference numerals indicating identical or functionally similar elements across the separate views, are integral to this specification. They complement the detailed description below, providing visual illustrations of the embodiments and further elucidating the concepts, principles, and advantages associated with the claimed invention.

Figure 1:
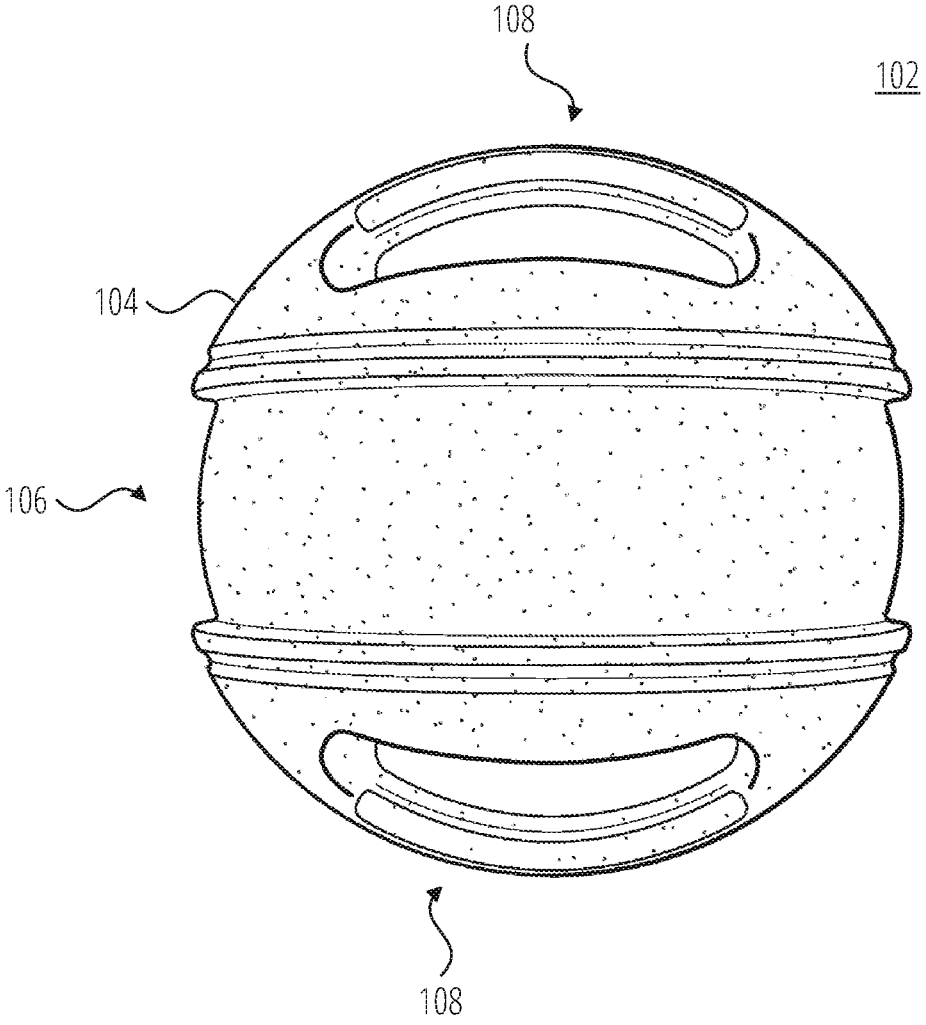
FIG. 1 is a perspective view of the SmartSphere Adjustable Medicine Ball with handles, illustrating its overall design and features. The ball is shown with textured handles and a seamless exterior surface, allowing for easy grip and comfortable use during exercises. There is a notch in the center of the ball that allows the weighted bands to seamlessly fit without moving during exercise. The adjustable weight mechanism is not visible in this view.

It should be noted that the drawings are provided for illustrative purposes and are not necessarily drawn to scale. The purpose of the drawings is to enhance the understanding of the invention and its various embodiments.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The present invention provides a novel method of a medicine ball allowing users to adjust the weight of the ball using a weight band system to their desired level.

Figure 2:
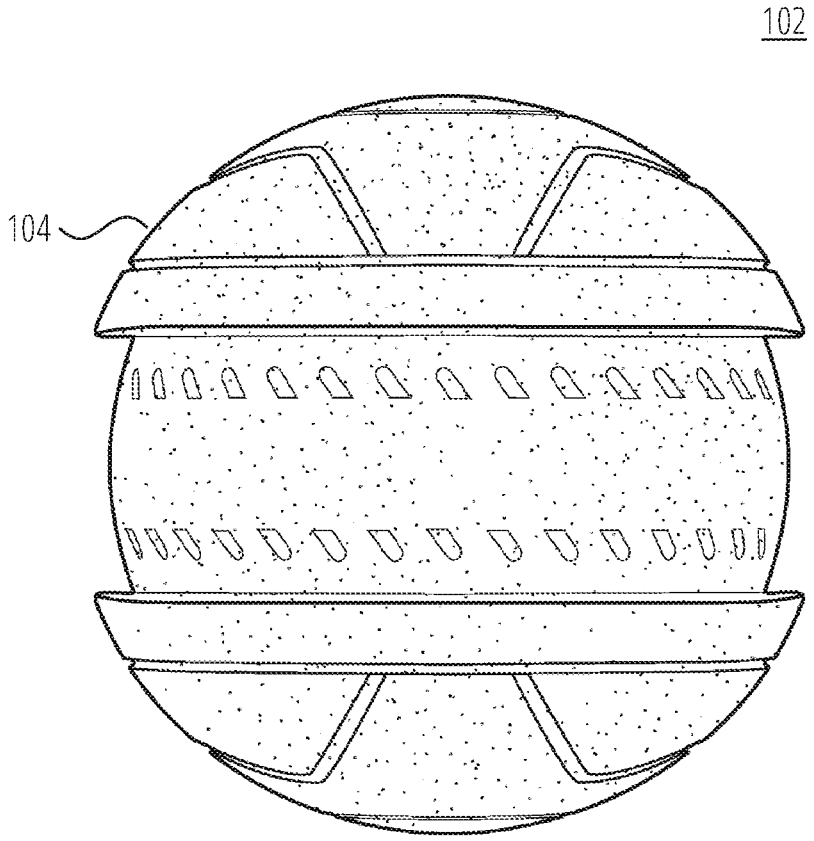
FIG. 2 is a perspective view of the SmartSphere Adjustable Medicine Ball without handles, illustrating its overall design and features. The ball is shown with a textured exterior surface, allowing for easy grip and comfortable use during exercises. There is a notch in the center of the ball that allows the weighted bands to seamlessly fit without moving during exercise. The adjustable weight mechanism is not visible in this view.

The invention shown in FIG. 1 and FIG. 2 shows a ball-shaped frame 104 with or without handles 108 that can be made of heavy material, such as rubber, plastic, leather and any similar materials. The primary weight frame 104 is constructed as a one-piece unit. The central notch 106 allows users to attach and detach various sized weight bands 302. The attachments as shown in FIG. 5 and FIG. 6, are fitted within the primary base of the notch 106 leaving no gaps and a tightly secured device as seen in FIG. 3 and FIG. 4.

Figure 3:
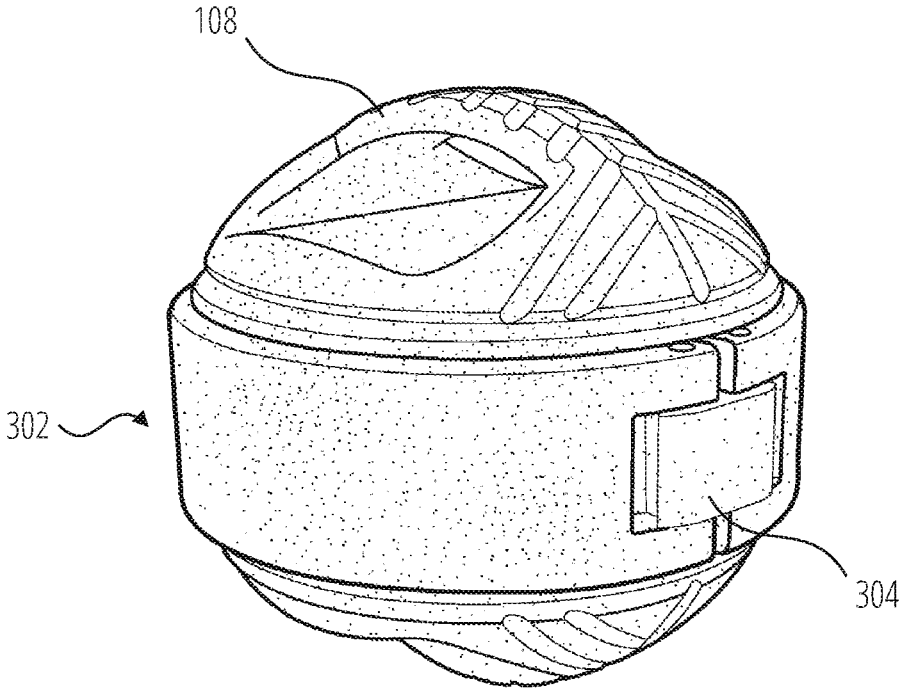
FIG. 3 illustrates an installed view of weighted band that can be added and removed from the medicine ball with handles, in accordance with an embodiment of the present disclosure.
Figure 4:
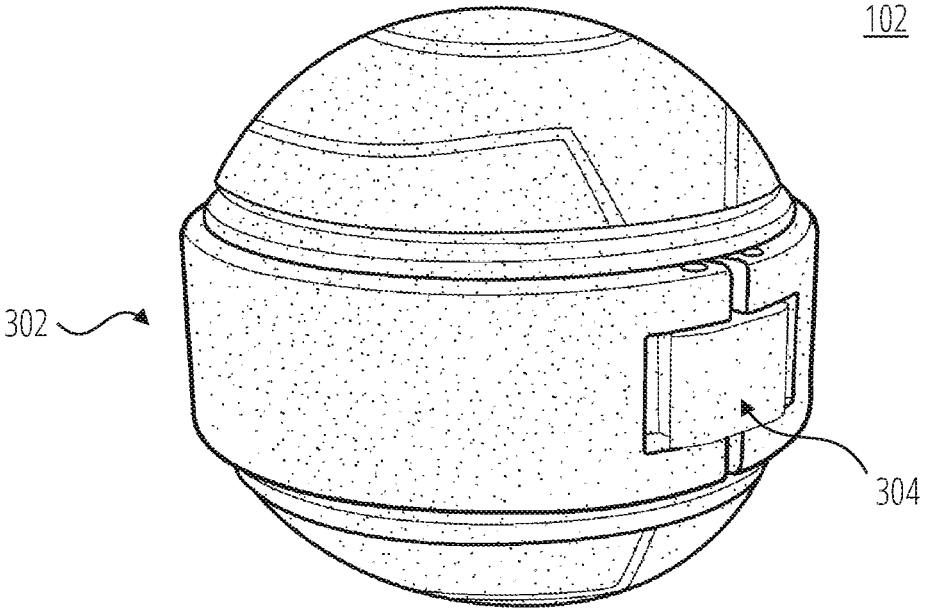
FIG. 4 illustrates an installed view of weighted band that can be added and removed from the medicine ball without handles, in accordance with an embodiment of the present disclosure.

FIG. 3 and FIG. 4 are showing the primary medicine ball 102 with the outer attachments 302 in their nested orientation such that the right and left weight attachment 504, 502 are nesting within each other maintains the center of gravity in a fixed location. As a feature of the present invention, the attachments are color coded so that the user can easily see what attachments are being used with the exercise device.

Figure 5:
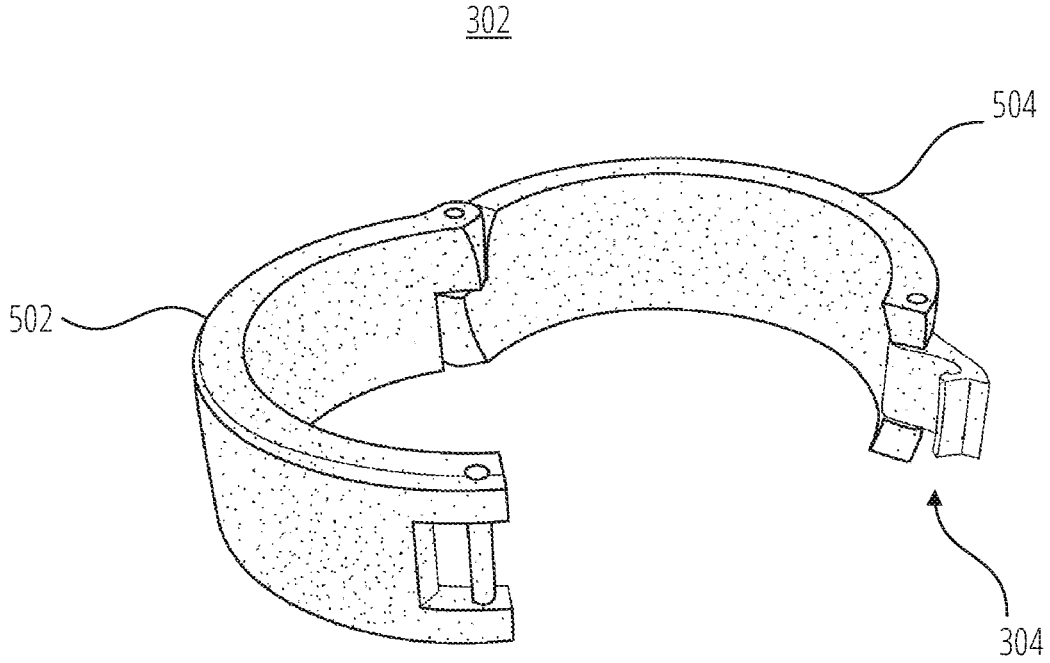
FIG. 5 is an open perspective view of the weighted band. The weighted band firmly hugs the ball making it as a one unit, in accordance with an embodiment of the present disclosure.
Figure 6:
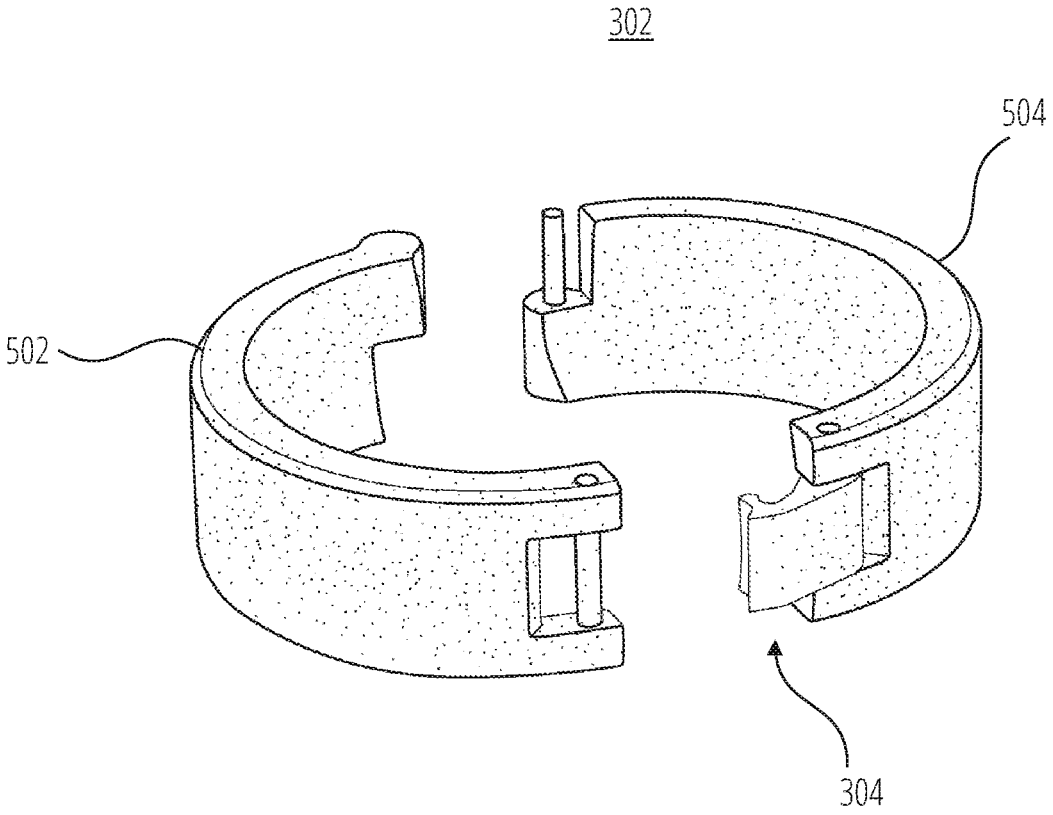
FIG. 6 is an illustrated view of the band separated and removed from the medicine ball, in accordance with an embodiment of the present disclosure.

FIG. 5 and FIG. 6 are showing the weighted band system that is both detachable from the ball 102 and from one another for easy storage. The removable weight bands 302 are made of a durable and flexible material that is easy to attach and detach from the ball 102. The bands 302 use a secure locking mechanism 304 to ensure the ball can 102 with withstand heavy exercise.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An adjustable medicine ball comprising:

a spherical body with a seamless exterior surface having a texture, wherein the spherical body has a central notch extending around a periphery of the spherical body;

one or more handles positioned on opposite sides of the spherical body for improved grip and control during exercise, wherein the one or more handles are integrated into the spherical body;

one or more weighted bands configured to engage the central notch on the spherical body, wherein the one or more weighted bands are configured to modify the weight of the adjustable medicine ball; and wherein a locking mechanism is disposed on each of the one or more weighted bands and configured to secure the one or more weighted bands to the central notch.

2. The adjustable medicine ball of claim 1, wherein the one or more weighted bands are securely attached to the spherical body using a fastening system fitted into the central notch of the adjustable medicine ball.

3. The adjustable medicine ball of claim 1, wherein the seamless exterior surface is made of a durable and easy-to-clean material, ensuring longevity and hygienic use.

4. The adjustable medicine ball of claim 1, wherein the one or more weighted bands are offered in various weight options to cater to users of different fitness levels and goals.

5. The adjustable medicine ball of claim 1, wherein the adjustable medicine ball is designed to improve muscle strength, coordination, and overall fitness, while reducing the need for multiple medicine balls of different weights, saving space and time during workouts.

6. A method of adjusting a weight of a medicine ball, the method comprising:

providing an adjustable medicine ball with one or more weighted bands, wherein the adjustable medicine ball has a central notch extending around a periphery of the adjustable medicine ball, and wherein the central notch is configured to receive and retain one of the one or more weighted bands;

unlocking a locking mechanism of one of the one or more weighted bands;

adding or removing one or more weighted bands from the central notch of the adjustable medicine ball according to a desired weight of the one or more weighted bands; and securely locking the locking mechanism of the one or more weighted bands to secure the one or more weighted bands to the central notch of the adjustable medicine ball.

7. The method of claim 6, wherein a weight adjustment can be made, via the one or more weighted bands, quickly and easily without requiring additional tools or equipment.

8. The method of claim 6, wherein the one or more weighted bands remain stable and secure during exercise, ensuring a safe and effective workout experience.

9. The method of claim 6, further comprising enabling users to customize their workout intensity and challenge levels by adjusting the weight of the adjustable medicine ball according to their fitness goals and progress.

10. The method of claim 6, further comprising providing a versatile and space-saving solution for individuals and fitness facilities, thereby eliminating the need for multiple medicine balls of different weights.

11. The method of claim 6, further comprising incorporating an ergonomic design and textured handles to the adjustable medicine ball to enhance grip, comfort, and control during exercise routines.

12. An adjustable medicine ball comprising:

a spherical body with a seamless exterior surface having a texture, wherein the spherical body has a central notch extending around a periphery of the spherical body;

one or more weighted bands configured to engage the central notch on the spherical body, wherein the one or more weighted bands are configured to modify the weight of the ball; and wherein a locking mechanism is disposed on each of the one or more weighted band and configured to secure the one or more weighted bands to the central notch.

13. The adjustable medicine ball of claim 12, wherein each the one or more weighted bands comprises a first band segment coupled to a second band segment.

* * * * *